US007784609B2

(12) United States Patent
Frost

(10) Patent No.: US 7,784,609 B2
(45) Date of Patent: Aug. 31, 2010

(54) CONVERTIBLE HOLDER FOR A CONSUMER ARTICLE

(76) Inventor: David Frost, 3132 SE. 28th Ave., Portland, OR (US) 97202

( * ) Notice: Subject to any disclaimer, the term of this patent is extended or adjusted under 35 U.S.C. 154(b) by 0 days.

(21) Appl. No.: 12/373,716

(22) PCT Filed: Jul. 9, 2007

(86) PCT No.: PCT/US2007/073056

§ 371 (c)(1),
(2), (4) Date: Jan. 13, 2009

(87) PCT Pub. No.: WO2008/011293

PCT Pub. Date: Jan. 24, 2008

(65) Prior Publication Data

US 2009/0255833 A1 Oct. 15, 2009

Related U.S. Application Data

(60) Provisional application No. 60/807,603, filed on Jul. 17, 2006.

(51) Int. Cl.
*B65D 51/00* (2006.01)
*B65D 5/50* (2006.01)
*B65D 25/54* (2006.01)

(52) U.S. Cl. ..... 206/45.28; 206/736; 206/774

(58) Field of Classification Search ..... 206/361, 206/362.1, 362.2, 45.2, 736, 774; 211/65, 211/66; 220/213, 23.4; 312/293.1, 293.3, 312/206; 403/231

See application file for complete search history.

(56) References Cited

U.S. PATENT DOCUMENTS

| | | | | | |
|---|---|---|---|---|---|
| 1,378,363 | A | * | 5/1921 | List | 206/45.23 |
| 2,673,641 | A | | 3/1954 | Carrillo | |
| 2,815,057 | A | | 12/1957 | Tupper | |
| 3,124,399 | A | | 3/1964 | Seta | |
| 3,325,847 | A | | 6/1967 | Meranto | |
| 3,663,717 | A | * | 5/1972 | Coster | 426/104 |
| 4,053,047 | A | * | 10/1977 | Andreaggi | 206/45.2 |
| 4,234,087 | A | * | 11/1980 | Pandak | 206/362.2 |
| 4,610,363 | A | * | 9/1986 | Flum et al. | 211/74 |
| 4,666,036 | A | * | 5/1987 | Bourbon | 206/45.23 |
| 5,076,428 | A | | 12/1991 | Shaw | |
| 5,193,931 | A | * | 3/1993 | Arato | 403/231 |
| 5,372,249 | A | | 12/1994 | Grange | |
| 5,480,027 | A | | 1/1996 | Leonard | |
| 5,630,505 | A | | 5/1997 | Garcia | |
| 5,687,855 | A | | 11/1997 | Heller | |

(Continued)

OTHER PUBLICATIONS

International Search Report and Written Opinion of the International Searching Authority dated Jun. 18, 2008, pp. 1-8.

*Primary Examiner*—Ehud Gartenberg
*Assistant Examiner*—Kaushikkumar Desai
(74) *Attorney, Agent, or Firm*—Ganz Law, P.C.

(57) ABSTRACT

A convertible holder for enclosing a consumer article formed by at least two combinable pieces forming an enclosure wherein at least one combinable piece may be converted from forming a part of the enclosure to a support base that attaches to another combinable piece at a transverse angle and the other combinable piece continues to partially enclose the article. The combination of base and enclosing pieces supporting the article at a height above a base surface.

3 Claims, 4 Drawing Sheets

U.S. PATENT DOCUMENTS

| | | | | |
|---|---|---|---|---|
| 5,875,516 | A | 3/1999 | Blue | |
| 5,924,566 | A * | 7/1999 | Gibbs | 206/361 |
| 5,927,487 | A | 7/1999 | Whittle et al. | |
| 6,170,113 | B1 | 1/2001 | Cornu et al. | |
| 6,253,406 | B1 | 7/2001 | Holland | |
| 6,343,700 | B1 | 2/2002 | Slendebroek et al. | |
| 6,382,406 | B1 * | 5/2002 | Corbasson | 206/5 |
| 6,757,931 | B2 * | 7/2004 | Nordstrom | 206/361 |
| 6,758,446 | B2 | 7/2004 | Bjornrud | |
| 6,866,147 | B2 * | 3/2005 | Barwick | 206/363 |
| 6,907,638 | B2 | 6/2005 | Katz | |
| 2002/0104426 | A1 * | 8/2002 | Fediakov | 84/329 |

* cited by examiner

CONVERTIBLE HOLDER FOR A CONSUMER ARTICLE

RELATED APPLICATIONS

This application claims priority to and the benefit of U.S. provisional application No. 60/807,603, filed Jul. 17, 2006 entitled CONVERTIBLE HOLDER FOR A CONSUMER ARTICLE, the contents of which is hereby incorporated by reference as if recited in full herein for all purposes.

BACKGROUND

The inventive subject disclosed herein relates to a convertible holder or container for an article that has a first configuration for storage of the article and which may be converted to a second configuration for supporting the article on a surface in space. The holder is particularly suited for holding a toothbrush, razor, or other toiletry article. The following discussion will relate to a toothbrush and razor holder as representative articles.

Most toothbrush containers enclose a toothbrush when traveling. However, they are elongate containers that come in two attachable halves to form an enclosure. The elongate structures do no stand upright on their own. Typically, travelers have hygienic concerns about leaving a toothbrush on the counter top of a bathroom: they either must find a cup or other support object to place their tooth brush for easy access or keep the toothbrush in the travel holder. As to the former option, supporting structures are not always available, do not retain the tooth brush well, or can tip over too easily. As to the latter option, once the toothbrush has been used however, enclosing it again without drying can lead to the growth of bacteria, mold, or mildew. This may be avoided by drying the toothbrush before reinserting it into the holder. Remedies such as shaking the brush do not dry the bristles effectively, while laying the brush down on a flat surface, such as the counter, may expose the handle and bristles to contamination of bacteria or other germs which are present on the horizontal surface. Both the holder and the brush may be contaminated after only one use of the brush. These circumstances may result in hygienic risks. Some attempts have been made to provide convenient and compact storage or travel holders that address the aforementioned problems and needs.

U.S. Pat. No. 4,234,087 ("Pandak") describes a combination toothbrush carrier and holder whereby the combination can both enclose a brush and hold a brush upright without overturning the device. The brush is stored in a tubular elongated housing which can be taken apart. The housing has several tubular portions, one of which may hold the handle end of the toothbrush with the brush leaning against the side of the tubular portion. Pandak discloses a holder that positions the tubular portions side by side to form a stabilizing base. The multiple pieces and steps of arrangement are not convenient to handle or manufacture. The connectors that extend from the exterior surfaces of the pieces are unsightly and not comfortable to handle.

U.S. Pat. No. 6,253,406 ("Holland") discloses a combined toothbrush handle and stand having flexible moveable shafts set into the handle of the toothbrush, which may be extended or retracted with the aid of a moveable ring, and creating a fully deployable stand alone base for the toothbrush. Holland describes a stand to expose the brush upside down.

SUMMARY

The inventive subject matter disclosed herein overcomes problems in the prior art by providing a convertible holder that addresses the aforementioned problems and needs. In certain embodiments, the inventive subject matter contemplates a convertible holder for enclosing a consumer article formed by at least two combinable pieces forming an enclosure wherein at least one piece may be converted from forming a part of the enclosure to a support base that attaches to another combinable piece at a transverse angle, and the other combinable piece continues to partially enclose the article, the combination of base and enclosing pieces supporting the article at a height above a base surface. In certain embodiments, the article is supported in a substantially upright position and the article may be easily removed by hand from the enclosing piece.

In one possible embodiment, the convertible holder may have at least one support and at least one base, the support and base being coupleable together to enclose the article. The support may have a first engageable element and the base may have a second engageable element, complementary to the first engageable element, for coupling the support to the base to support the article at a height above a base surface, wherein the article is supported at an inclined angle relative to the base surface. In another embodiment, the engageable elements may have complementary male and female components. In another embodiment, the engageable elements on the support and the base may have complementary recessed notches. In another embodiment, the engageable elements may have snaps. In another possible embodiment, the engageable elements may have hook and loop fastener. In another possible embodiment, the engageable elements may have magnets.

In another possible embodiment, the inventive subject matter contemplates a kit, having a convertible holder and an article to be held or an article to be used with the article to be held. In one possible embodiment, the article may be a toothbrush, toothpaste, or a razor.

In another possible embodiment, the kit may include a toothbrush having a brush end, and a convertible holder for enclosing the toothbrush. The holder may have a support having a first engageable element and a base having a second engageable element, complementary to the first engageable element, for coupling the support to the base to support the toothbrush at a height above a base surface, wherein the article is supported at an inclined angle relative to the base surface.

In another possible embodiment a kit, may include a razor, having a shaft and a bladed area perpendicular disposed on the shaft, and a convertible holder adapted to enclose the razor. The holder may have at least two pieces that are combinable together to form an enclosure for the razor, one piece being convertible from being a part of the enclosure to a support base that attaches to the other combinable piece that continues to partially enclose the article, the combination of base and enclosing pieces support the razor's bladed area at a height above a base surface and wherein the razor is supported at an inclined angle relative to the base surface with the bladed area exposed. In another embodiment, a kit may include a convertible holder wherein the support and base are hingeably coupled and the base converts from forming part of the holder to a support base.

According to the inventive subject matter disclosed herein, the convertible holder may be formed of a molded material or a flexible material. The inventive subject matter disclosed herein also contemplates a method for making such a convertible holder for enclosing a consumer article by providing a first combinable piece with a second combinable piece to form an enclosure wherein at least one combinable piece may be converted from forming a part of the enclosure to a support base that attaches to another combinable piece at a transverse angle and the other combinable piece continues to partially enclose the article, the combination of base and enclosing pieces supporting the article at a height above a base surface.

DETAILED DESCRIPTION

Figure 1:
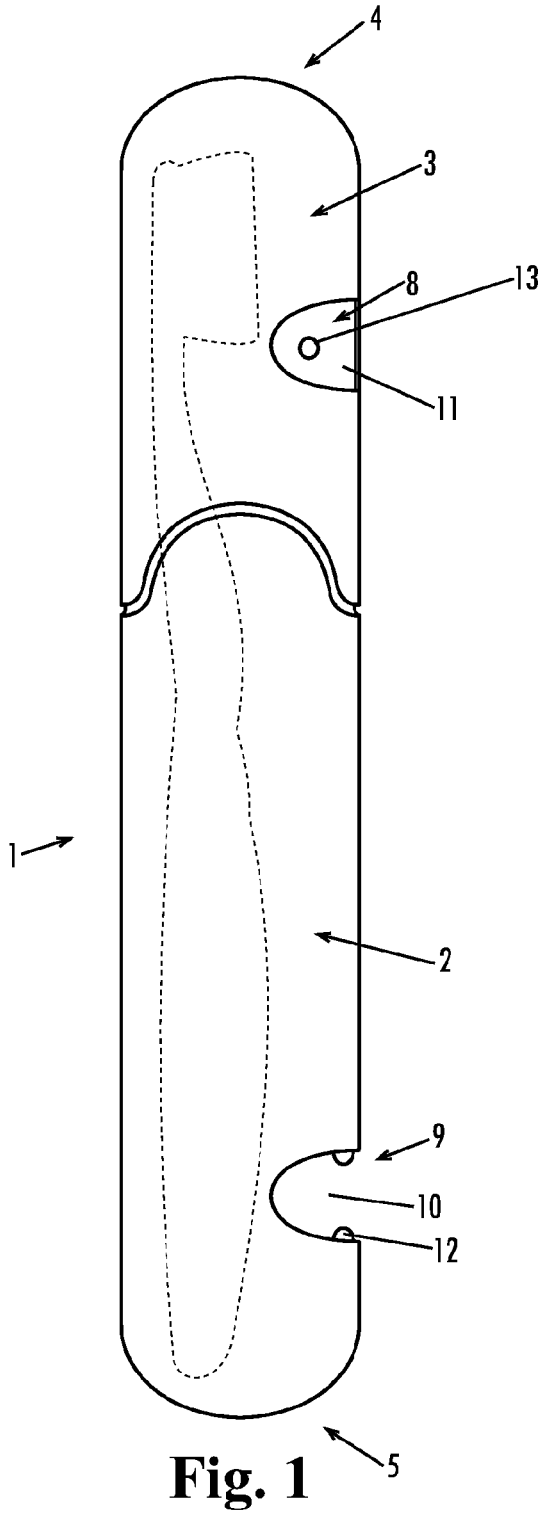
FIG. 1 is a front view of a toothbrush holder, with the holder in its closed position, according to a first embodiment of the inventive subject matter disclosed herein.

Representative embodiments of the present inventive subject matter are shown in FIGS. 1-6, wherein similar features share common reference numerals.

The convertible holder of the inventive subject matter includes a holder or enclosure 1 to hold an article such as an article of toiletry, for example a toothbrush, a razor, or other elongated element. The enclosure 1 may be formed from at least two combinable pieces wherein at least one combinable piece may be converted from forming a part of the enclosure to a support base that attaches to another combinable piece at a transverse angle and the other combinable piece continues to partially enclose the article, the combination of base and enclosing pieces support the article at a height above a base surface, such as a countertop. An article is understood to be at a height above a base surface when some or all the article is raised, typically the head of the article, i.e. brush or blades. The support and base are at a transverse angle relative to each other when the midlines of the support and base are running non-parallel to each other. In this position the article may be supported in an inclined position, allowing the article to be easily removed by hand from the enclosing piece and helping drip or drawing water from the article, but not into the enclosing piece.

Figure 2:
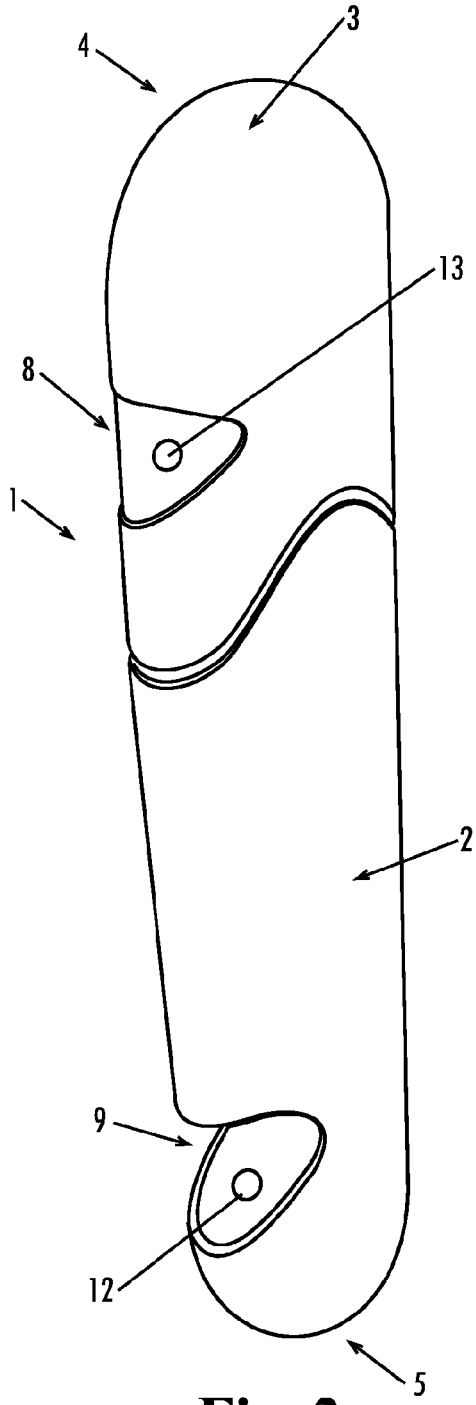
FIG. 2 is a perspective view of the holder of FIG. 1, shown in its closed position.
Figure 3:
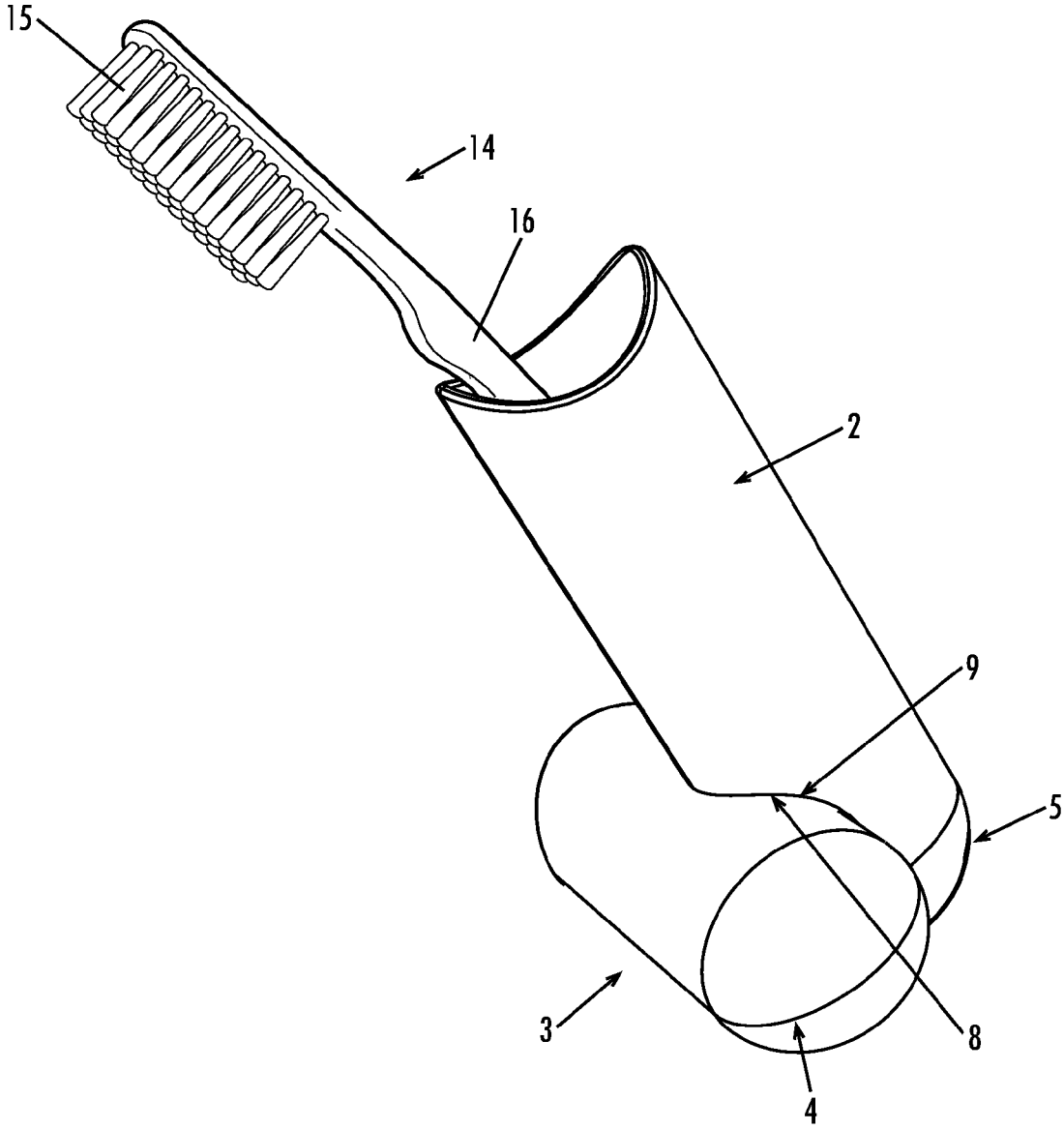
FIG. 3 is a perspective view of the holder of FIG. 1, shown in its open position.

As shown in FIGS. 1-3, the enclosure 1 may have a cylindrical or tubular structure, with respective closed ends 4 and 5. Enclosure 1 generally includes two combinable pieces: a support 2 and a base 3.

In the case of a toothbrush holder, a toothbrush 14 is typically placed in a substantially upright position, whereby the handle 16 of the toothbrush 14 is supported by the support 2 for drying or display of the brush end 15 and wherein the toothbrush 14 may be easily removed by hand from the support. When the toothbrush is to be transported, such as when traveling, the holder 1 encloses the toothbrush 14 to protect it from contact with other items. The two pieces are fitted together lengthwise to form a protective enclosure for the toothbrush. In the inclined position that provides a stand (FIG. 3), the support 2 is rotated about 90 degrees and attached to the base 3 in order to form a structure that supports the toothbrush 14. The "inclined position," as used herein, means a position where the toothbrush 14 is held at an angle other than about 90 degrees above a substantially horizontal base surface. As used here "substantially upright" means at an angle of about 90 degrees above a substantially horizontal surface, typically between 80 degrees to 100 degrees. Usually, the brush 14 is disposed in the tubular portion of enclosure 1 such that the handle 16 is supported by the side of the tubular portion while the brush end 15 is exposed.

FIGS. 1 and 2 show an elongated enclosure 1 in its closed position. The enclosure 1 is formed by a hollow tubular structure, which provides room for housing a toothbrush, as shown in phantom in FIG. 1.

Support 2 and base 3 are being coupled together to enclose the toothbrush with a detachable connection. For example, support 2 and base 3 may have different diameter so that they slide into one another and are secured by a friction fit. However, the coupling could be accomplished by any suitable means, such as a snap-in panel for example.

As shown in FIGS. 1-3, support 2 has a first engageable element 8, and base 3 has a second engageable element 9, complementary to the first engageable element 8. These engageable elements 8 and 9 allow support 2 and base 3 to be coupled in a position that allows a toothbrush to be raised above a base surface. These engageable elements allow the support 2 to be mounted on the base 3 at a transverse angle relative to each other. The engageable elements 8 and 9 are formed by complementary interlocking male and female components 12 and 13 located in recessed notches 10 and 11. It is understood, however, that the two pieces can be attached by a variety of means, such as hook and loop fastener, magnets or snaps. In some cases, no extra materials or structures (e.g. notches 10, 11 and components 12, 13) may be required to hold the support in an upright position relative to the base. For example, the engageable elements may be formed by complementary recessed notches only which provide a tensioned fit, based, for example, on fabricating the holder from a resilient material such as plastic.

FIG. 3 illustrates how the base 3 of the holder 1 is placed on a horizontal surface. The support 2 is coupled to the base 3 allowing support for a toothbrush 14 with the brush end 15 exposed. The recessed notches 10 and 11 are snapped together with the male and female components 12 and 13 interlocking. In this particular embodiment, the base 3 and support 2 form an angle of less than 90°. However, the two sections may be placed at any angle that allows the toothbrush to dry.

Figure 5:
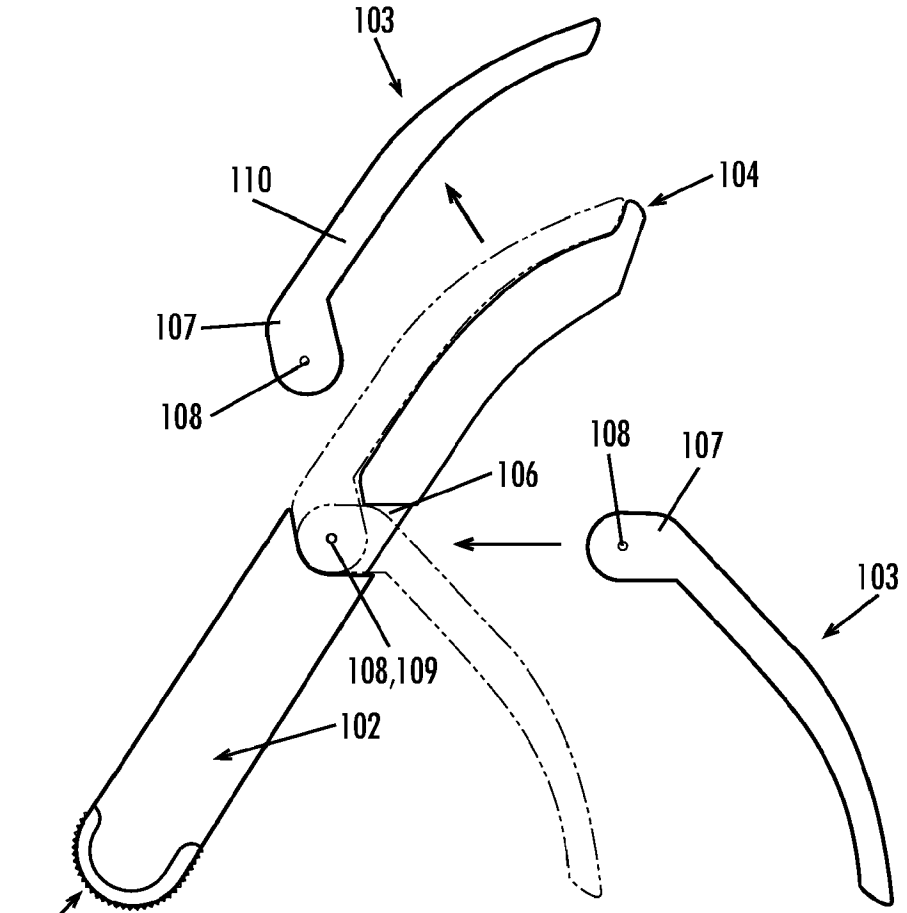
FIG. 5 is a side view of the holder for a razor of FIG. 4, showing the closed and open positions of the holder, and wherein the arrows indicate the movement of the holder's base as it is removed from the top and reattached to the sides of the holder.
Figure 4:
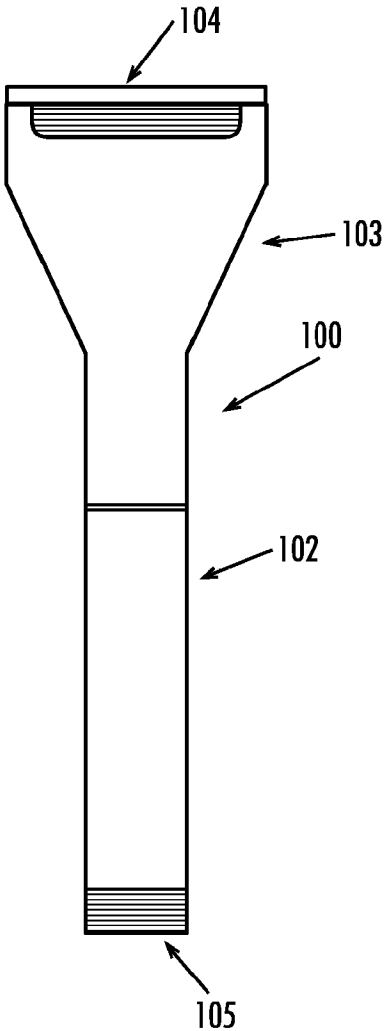
FIG. 4 is a front view of a holder for a razor, in its closed position, according to another embodiment of the inventive subject matter disclosed herein.
Figure 6:
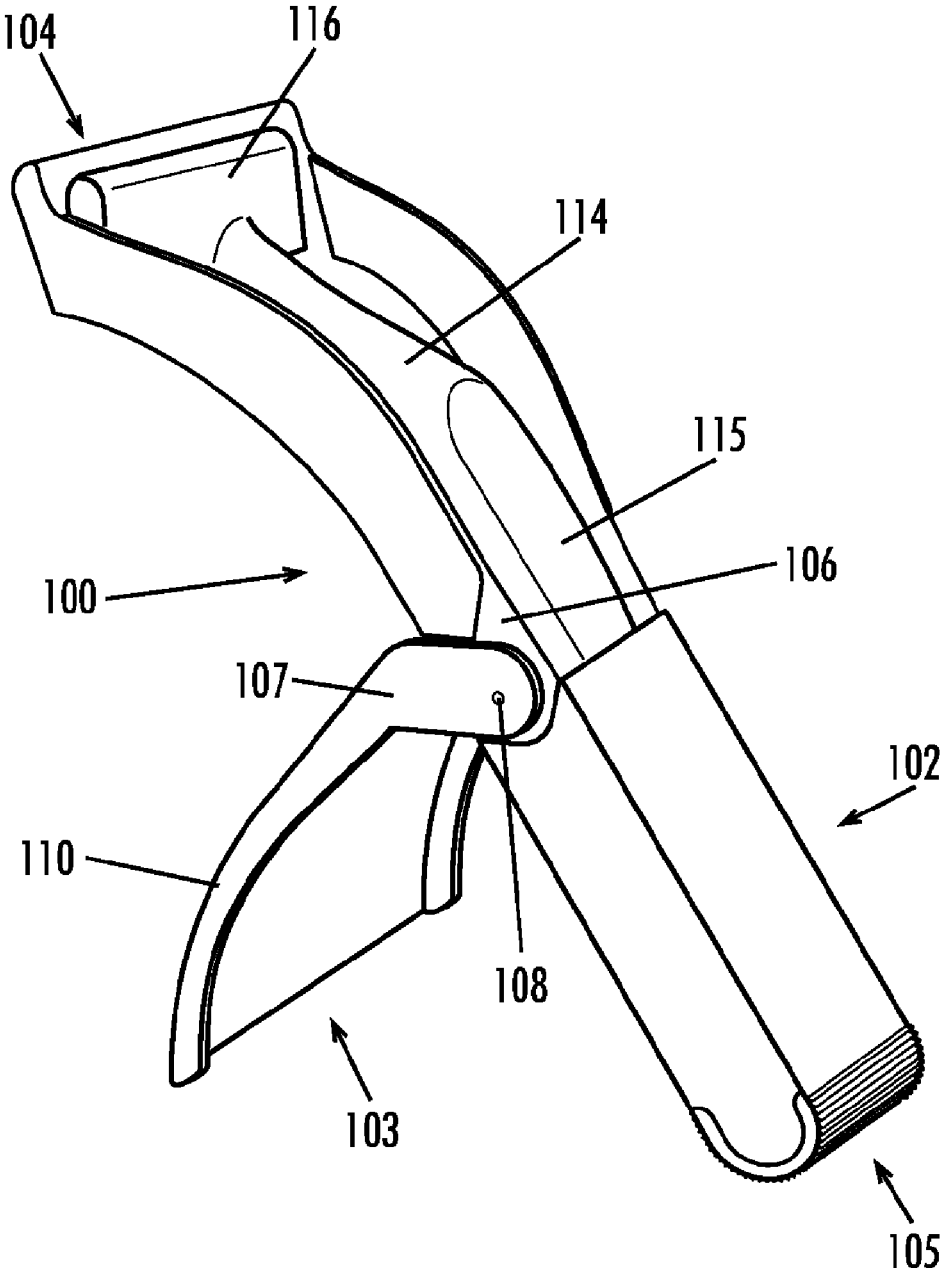
FIG. 6 is a perspective view of the razor holder of FIG. 4, in the open position.

In another embodiment of the inventive subject matter, the holder may be adapted to hold a razor, such as illustrated by FIGS. 4-6. The holder or enclosure 100 is formed by a hollow structure adapted to the shape of a razor and includes two combinable pieces: a support 102 and a base 103, with closed ends 104 and 105. The base 103 is removably coupled to support 102 to form an enclosure for the razor. The razor 114 may have a shaft 115 and a bladed area 116. The bladed area 116 is the area of the razor that is perpendicular to the shaft and contains one or more razor blades.

When the razor is to be transported, such as when traveling, support 102 and base 103 are fitted together lengthwise to form a protective enclosure for razor 114, as shown in FIG. 4. Holder 100 thereby encloses razor 114 to protect it from contact with other items. FIGS. 5 and 6 illustrate how the base 103 of holder 100 is placed on a horizontal surface to support and display the razor. The razor 114 is typically placed in an inclined position or substantially upright position, whereby the shaft 115 of the razor 114 is disposed in the holder 100 such that the shaft is supported by the side of a tubular portion of the holder at an inclined angle relative to a substantially horizontal base surface, while the blades of the razor are exposed for access, drying, or display.

FIG. 5 illustrates both the closed and open positions of the holder. The arrows indicate the movement of the holder's base 103 as it is removed from the top and reattached to the sides of the holder. To reach the transverse position the base 103 is rotated about 180 degrees and attached to the support 102 in order to form a structure that supports the razor 114.

Support 102 and base 103 may be coupled together by engageable elements in the form of a shaped recess 106 on support 102 and a complementary U-shaped brace 107 with attached snap-on panel 110 on base 103. Recess 106 and brace 107 may further have complementary snap-fit elements 108 and 109, allowing support 102 to be removably connected to base 103. However, support and base may be coupled together by any suitable means.

Alternatively, support and base could also be hingeably coupled so that the base converts from being a part of the holder to a support base by hinging around the support. It is understood, however, that the two pieces can be attached by a variety of means, such as hook and loop fastener or magnets. In some cases, the specific design of a holder may allow for a system that rotates or a system that does not require extra materials or structures to hold the support in an upright position relative to the base. In the embodiments shown, base 103 and support 102 are positioned at an angle of about 45°. However, the two pieces may be placed at any angle that allows the bladed area to dry.

The inventive subject matter also includes a method for making such a convertible holder by providing a first combinable piece with a second combinable piece to form an enclosure wherein at least one combinable piece converts from forming part of the enclosure to a support base, such that the combination of pieces supports the article at an inclined angle a above a base surface.

The enclosure may be formed by any suitable flexible material. The enclosure may be formed by molding pieces of plastic, or any other suitable material may be used, including metal and wood, for example. Optionally, antimicrobial coverage, such as for example MICROBAN™, may be applied to certain areas of the holder.

A kit may be provided with a holder and an article to be held or an article to be used with the article to be held. For example, a kit may include a toothbrush, toothpaste, or a razor, and its respective holder as described above. The holder may also be used for enclosing and exposing additional toiletry articles such as toothpaste. In alternative embodiments, the holder may be used to hold thermometers, artist's brushes or other articles.

Persons skilled in the art will recognize that many modifications and variations are possible in the details, materials, and arrangements of the parts and actions which have been described and illustrated in order to explain the nature of this inventive concept and that such modifications and variations do not depart from the spirit and scope of the teachings and claims contained therein. All patent and non-patent literature cited within this application is hereby incorporated by reference as if listed in its entirety herein.

What is claimed:

1. A holder for enclosing an article, the holder comprising a support being a bottom part and a base being a cap;

the base having an open top and a closed end;

the base closing the support at an open top of the support;

the support having a recess proximal to the closed end;

the support having interlocking elements inside the recess;

the base having on its outer surface interlocking elements complementing the interlocking elements of the recess;

the base engaging the support at one of the open top and the recess;

the base tightly fitting on its outer surface an inner surface of the recess, perpendicular to a longitudinal axis of the support, and the base and the support while interlocked with each other provide a stable position with the support and the base having their bottoms co-planar, and the support being tilted at an angle relative to the vertical.

2. A holder as claimed in claim 1, wherein the convertible holder comprises a molded material.

3. A holder as claimed in claim 1, wherein the convertible holder comprises a flexible material.

* * * * *